United States Patent [19]

Halsell, II et al.

[11] Patent Number: 4,948,033

[45] Date of Patent: Aug. 14, 1990

[54] MOISTURE RESISTANT CONTAINER

[75] Inventors: Hampton L. Halsell, II, Fort Smith, Ark.; William W. Galloway, Memphis, Tenn.; David H. Shults, Spartanburg, S.C.

[73] Assignee: The Mead Corporation, Dayton, Ohio

[21] Appl. No.: 929,501

[22] Filed: Nov. 10, 1986

[51] Int. Cl.[5] ..... B65D 5/18

[52] U.S. Cl. ..... 229/23 R; 229/117.16; 229/119; 229/191; 229/915; 229/918; 229/919; 229/DIG. 11

[58] Field of Search ..... 229/23 R, 119, 191, 229/915, 918, 919, DIG. 11, 52 B, 16 R; 206/503, 586, 594; 220/441; 493/89, 162, 167, 904, 906

[56] References Cited

U.S. PATENT DOCUMENTS

| | | | |
|---|---|---|---|
| 987,206 | 3/1911 | Wilson | 229/23 R |
| 1,664,308 | 3/1928 | Miller | 229/919 |
| 2,484,975 | 10/1949 | Van Saun | 229/23 R |
| 3,097,781 | 7/1963 | Masi | 229/23 R |
| 3,128,033 | 4/1964 | Cook | 229/52 B |
| 3,159,326 | 12/1964 | Stonebanks | 229/43 |
| 3,696,989 | 10/1972 | Kochevar | 229/119 |
| 4,417,686 | 11/1983 | Wozniacki | 229/191 |
| 4,596,542 | 6/1986 | Moen | 493/89 |

FOREIGN PATENT DOCUMENTS

| | | | |
|---|---|---|---|
| 419770 | 11/1934 | United Kingdom | 220/441 |
| 2081225 | 2/1982 | United Kingdom | 229/915 |

*Primary Examiner*—Stephen Marcus
*Assistant Examiner*—Gary E. Elkins
*Attorney, Agent, or Firm*—B. J. Powell

[57] ABSTRACT

A multi-piece foldable container including a corrugated body blank and a pair of corrugated liner blanks. Support columns are found in the liner blanks at positions along the sides of the container while multiple layers of the corrugated fibreboard are provided at the ends of the container to reduce tear out at the hand holes.

16 Claims, 7 Drawing Sheets

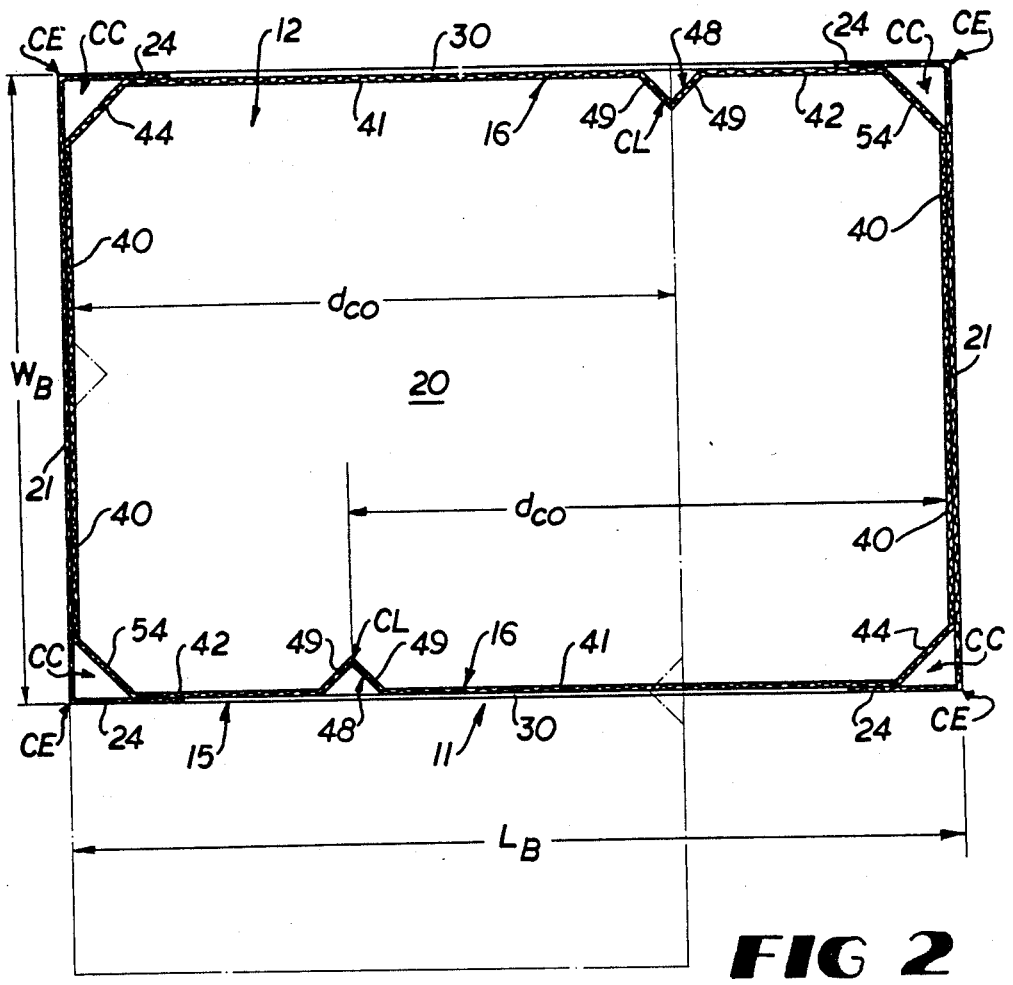
FIG 2
FIG 7 FIG 6 FIG 5
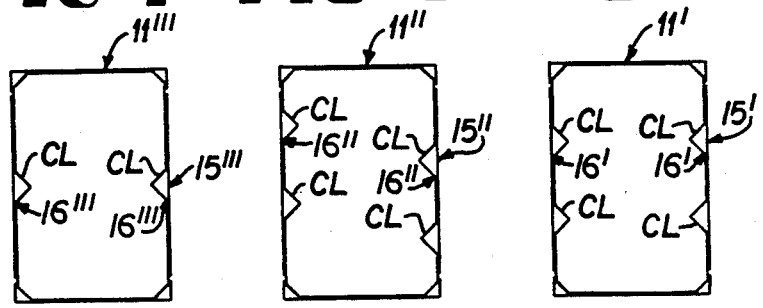

MOISTURE RESISTANT CONTAINER

BACKGROUND OF THE INVENTION

This invention relates generally to foldable containers and more particularly to a reinforced foldable container suitable for ice packed meat products such as poultry and the like.

Fresh poultry has for many years been shipped in paperboard containers with the containers filled with crushed ice to keep the poultry cool during shipment. These containers may be individually stacked on top of each other and/or in pallet loads during shipment and storage. The containers may be maintained in this stacked configuration for a significant period of time in the food distribution chain. Thus, the stacking strength of these containers is critical to prevent the collapse thereof while the containers are being transported or stored and must maximize the stacking strength of the container over an extended period of time as the moisture from the ice penetrates the container.

The containers in use today are typically single wall, corrugated containers with an open top box that is loaded with the poultry and ice and a cover which fits over the open top of the box. One of the problems associated with these prior containers is that their stacking strength deteriorates rapidly once the containers are loaded. As a result of container failure, the poultry may become exposed to the elements and contamination while the stacked containers may collapse during storage and transportation, especially in those distribution chains where the poultry is not delivered within a few days. U.S. Pat. No. 3,097,781 issued July 16, 1963 to Masi shows an ice pack poultry container of solid fidreboard with reinforcing posts formed adjacent the corners thereof. The following patents show internally reinforced containers which are not designed specifically for ice pack use but have improved stacking characteristics

| U.S. Pat. No. | Title | Inventor | Issue Date |
|---|---|---|---|
| 1,653,116 | Shipping Crate | Parks | Dec. 20, 1927 |
| 4,056,223 | Foldable Container and Blank Therefor | Williams | Nov. 1, 1977 |
| 4,581,005 | Manufacture of Boxes with Integrally Reinforced Walls | Moen | Apr. 8, 1986 |
| 4,596,542 | Manufacture of Internally Reinforced Boxes | Moen | June 24, 1986 |

The following patents show reinforced bulk containers for shipping heavy flowable materials. These containers are typically assembled in a different manner than the smaller containers such as those used to ship poultry and are not specifically designed for ice pack materials.

| U.S. Pat. No. | Title | Inventor | Issue Date |
|---|---|---|---|
| 3,159,326 | Multiply Fibreboard Containers | Stonebanks | Dec. 1, 1964 |
| 3,397,831 | Reinforced Bulk Pack Container | Adams | Aug. 20, 1968 |
| 4,081,124 | Carton Wall with Reinforcing Rib | Hall | March 28, 1978 |
| 4,341,338 | Corrugated Box Bulk Materials | Arnold | July 27, 1982 |

-continued

SUMMARY OF THE INVENTION

These and other problems and disadvantages associated with prior art containers are overcome by the invention disclosed herein by the provision of support columns located along the side walls of the container to improve stacking strength while still providing sufficient tearout strength at the end walls of the container to support the loads during handling. Provision is also made for minimizing the deleterious effect of the water from the melting ice on the primary strength producing configuration of the container. One embodiment of the invention also provides for the use of different fibreboard strengths in the components for the container so that the cost thereof can be minimized.

The container of the invention includes an open top box which is closed by a flanged cover. The open top box may be constructed out of a body blank and a pair of liner blanks. The liner blanks have support columns foldably formed therein and located along opposite sides of the box while the end panels on the body blank are overlapped by the ends of the liner blanks to provide a double wall construction at the ends of the box for lifting the box when loaded without tearout. The liner blanks and erected columns project above the side flaps on the body blank to minimize board usage while maintaining side wall strength. The columns may be offset transversely across the box to maximize the bending strength of the box. Drain holes are provided to drain the interior of the columns to minimize moisture exposure.

These and other features and advantages of the invention will become more clearly understood upon consideration of the following detailed description and accompanying drawings wherein like characters of reference designate corresponding parts throughout the several views in which:

BRIEF DESCRIPTION OF THE DRAWINGS

FIG. 2 is a top plan view of the open top box of the container with a cross-stacked container superimposed thereon in phantom;

FIG. 5 is a schematic top view showing a second configuration of the support column arrangement in the first embodiment of the open top box;

FIG. 6 is a schematic top view showing a third configuration of the support column arrangement in the first embodiment of the open top box;

FIG. 7 is a schematic top view showing a fourth configuration of the support column arrangement in the first embodiment of the open top box;

These figures and the following detailed description disclose specific embodiments of the invention, however, the inventive concept is not limited thereto since it may be embodied in other forms.

DETAILED DESCRIPTION OF ILLUSTRATIVE EMBODIMENTS

The container of the invention is designed primarily for use in shipping ice packed meats such as poultry. The container is appropriately coated with a water barrier to reduce moisture induced container failure. The container is designed to give the desired life and strength before failure due to moisture penetration while at the same time minimizing the amount of fibreboard required.

Figure 1:
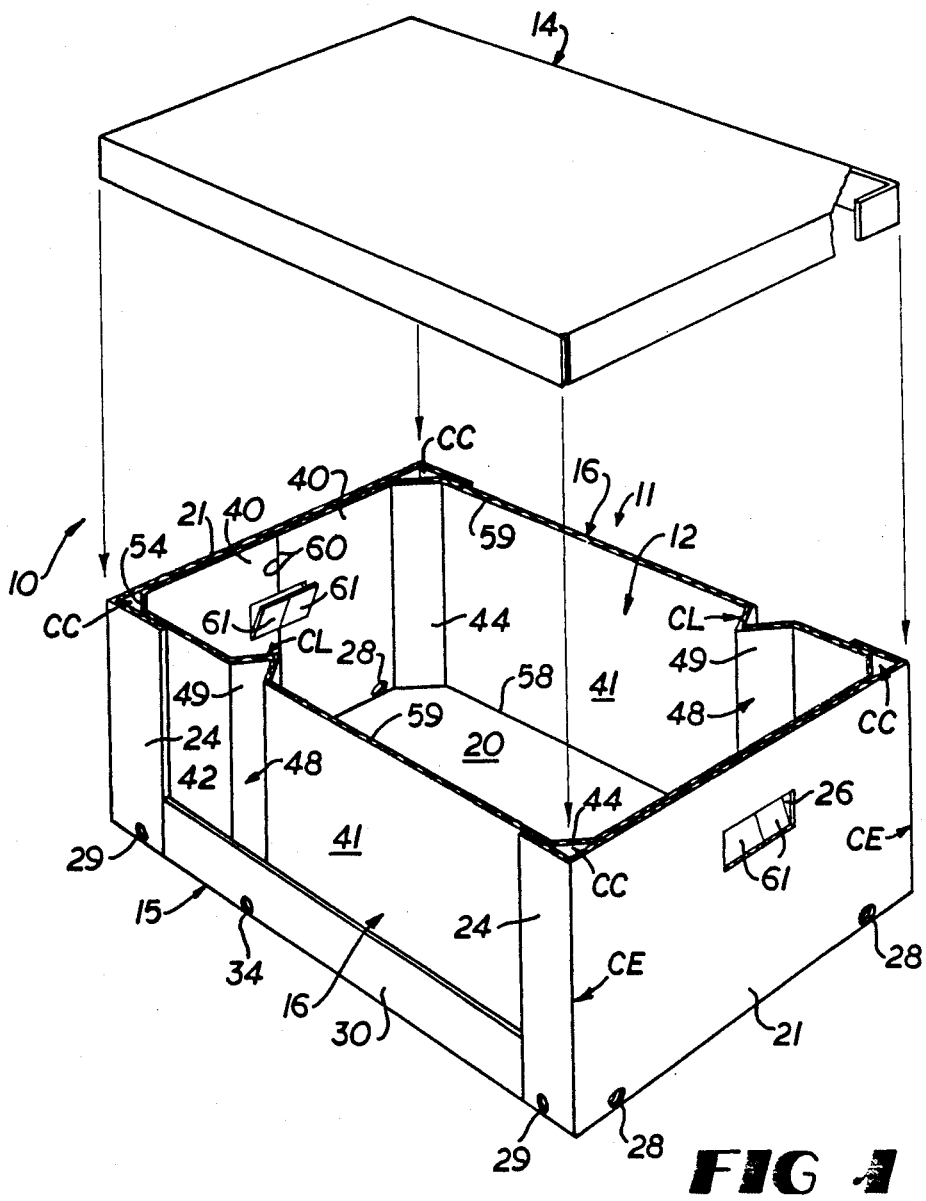
FIG. 1 is an exploded perspective view of one embodiment of the invention.
Figure 3:
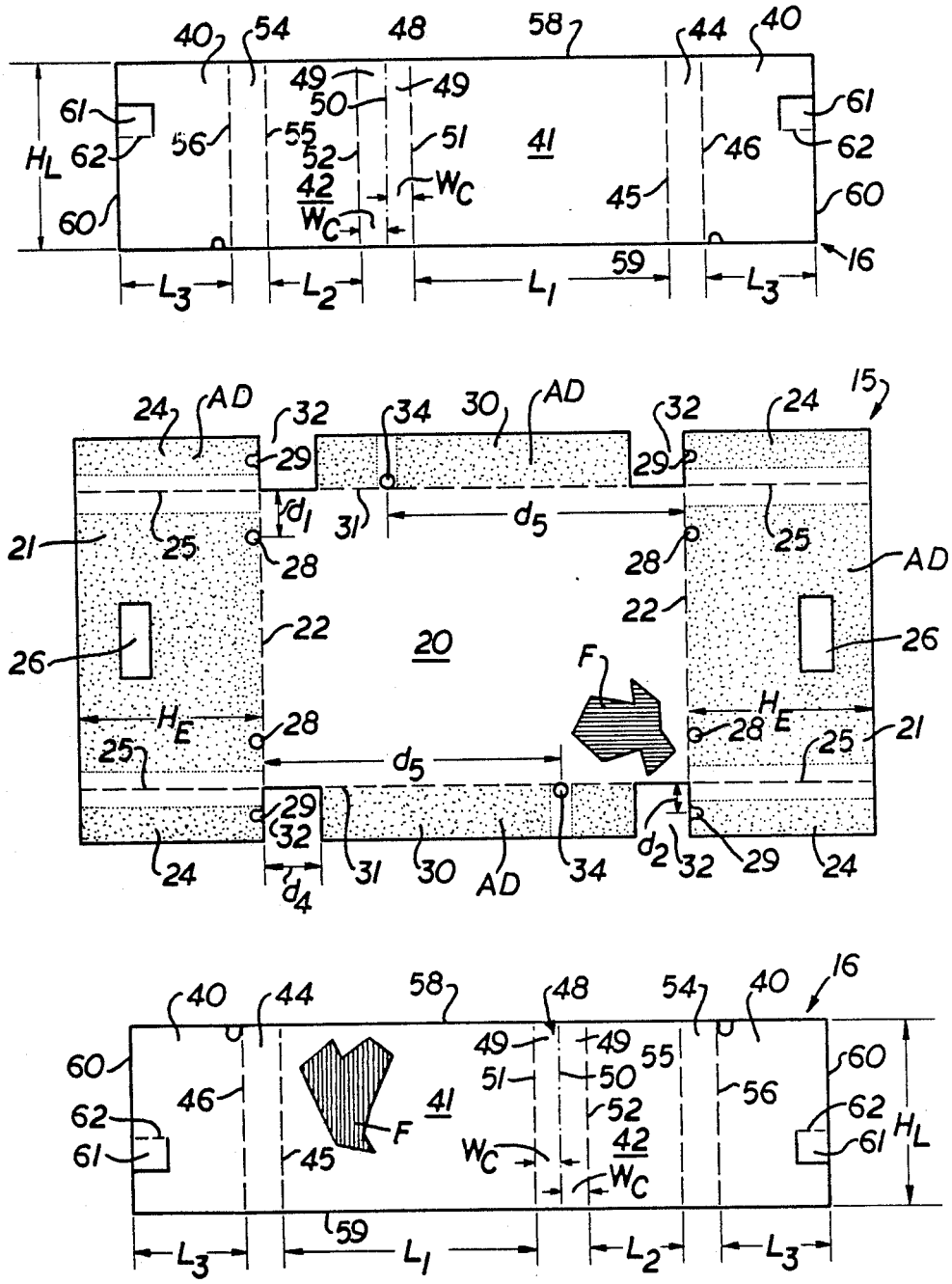
FIG. 3 is a plan view of the blanks used to make the first embodiment of the open top box of the container seen in FIG. 1.

FIG. 1 shows a first embodiment of the erected container which has been designated 10 and which comprises an open top box 11 defining a product receiving cavity 12 therein and which is closed by a flanged cover 14. The open top box 11 is erected from a main body blank 15 and a pair of liner blanks 16 as seen in FIG. 3. The cover 11 is conventionally made from a single blank. The sheet material forming the blanks is typically single wall corrugated fibreboard although solid fibreboard may be used. The blanks are made on conventional blank forming equipment which automatically slots, slits, scores and punches the blanks.

The main body blank 15 includes a rectilinear bottom panel 20 with opposed ends and opposed sides. A pair of end panels 21 are foldably Joined to the bottom panel 20 along the opposite ends thereof at end fold lines 22 The end panels 21 have a length corresponding to the width of the box to be erected therefrom and a $H_E$ corresponding the height of the box to be erected therefrom.

A pair of end flaps 24 are integral with opposite side edges of each end panel 21 along edge fold lines 25 so that the end flaps 24 can fold along the lines 25 inwardly around the liner blanks as the box is erected. The end flaps 24 have a transverse width $W_F$ which is sufficiently long to span the corner of the liner when the box is erected but with a minimum amount of overlap to reduce material consumption. A typical width $W_F$ is about 1.5–3 inches. The end flaps 24 have the same height as the end panels 21 to provide support for the end panel 21 as will become more apparent.

A handhold cutout 26 is centrally located in the end panel 21 in the upper portion thereof as will become more apparent. Weep holes 28 are provided through the end panel 21 adjacent the end fold line 22 as best seen in FIG. 3. The weep holes 28 are located a distance $d_1$ inboard of the edge fold line 25 to provide clearance of the corner structure of the box as will become more apparent. A pair of baffle drain holes 29 are provided through the lower edge of the end flaps 24 to drain the corner structure of the box after it is erected as will become more apparent. The drain holes 29 are located a distance $d_2$ from the edge fold lines 25.

A pair of side flaps 30 are foldably Joined to the bottom panel 20 along the opposite side edges thereof at side fold lines 31. The side flaps 30 are centered along the length of the bottom panel 20 and have a length less than the length of the bottom panel 20 so as to form cutouts 32 between the ends of the side flaps 30 and the bottoms of the end flaps 24. The ends of the side flaps 30 are located a distance $d_4$ from the bottom edge of the adjacent end flap 24. Thus, when the side flaps 30 are folded up and the end flaps 24 are folded around, the end flaps 24 will not interfere with the side flaps 30. Each side flap 30 is provided with a column drain hole 34 which is located a distance $d_5$ from one of the end fold lines 22 while the column drain hole 34 in the opposite side flap 30 is located the distance $d_5$ from the opposite end fold line 22. The distance $d_5$ corresponds to the width $W_B$ of the bottom panel 20. Since the containers 10 are usually rectilinear, the length $L_B$ of the bottom panel 20 is always greater than the width $W_B$.

The liner blanks 16 have the same configuration and are simply turned so that they are mirror images of each other when they are erected on body blank 15 to form the open top box 11. The liner blank 16 includes a pair of end sections 40 at opposite ends thereof adapted to lie against the end panels 21 as will become more apparent. The liner blank 16 also includes a major side section 41 and a minor side section 42 adapted to form one of the sides of the open top box as will become more apparent.

One end of the major side section 41 is connected to a corner baffle section 44 through fold line 45. The opposite side of baffle section 44 is connected to the end section 40 through fold line 46.

The major and minor side section 41 and 42 connected to each other through a column section 48. Column section 18 includes a pair of edge panels 49 Joined to each other about reverse fold line 50. One of the edge panels 49 is joined to the major side section 41 through the inward fold line 51 while the opposite edge panel 49 is Joined to the minor side section 42 through the inward fold line 52. The width $W_C$ of each of the edge panels 49 is selected to produce the desired size column as will become more apparent.

The opposite end of the minor side section 42 is connected to the corner baffle section 54 through the inward fold line 55. The opposite side of the corner baffle section 54 is foldable connected to the end section 40 through the fold line 56.

It will be seen that the liner blank 16 has a rectilinear shape with the various sections 40, 41, 42, 44, 48 and 51 having a common bottom edge 58 and a common top edge 59. The end sections 40 define projecting end edges 60 thereon. The liner blank 16 has a common height $H_L$ corresponding to the height $H_E$ of the end panels 26.

The column section 48 will be located along the length of the bottom panel 20 depending on the relative length $L_1$ of the major side section 41 and the length $L_2$ of the minor side section 42. These lengths $L_1$ and $L_2$ are selected for the first embodiment of the liner blank 16 so that, when the edge panels 49 and the column section 48 are folded along the reverse fold line 50 and the inward fold lines 51 and 52, the column formed thereby will be located in registration with the drain holes 31 at the distance $d_5$ from the fold line 22. Because the liner blanks 16 are erected so that they are mirror images of each other, one of the columns formed by the section 48 will be located at the distance $d_5$ from one of the fold lines 22 while the other column will be located from the other fold line the distance $d_5$. Thus, it will be seen that the columns in the erected box 11 will be located out of transverse alignment with each other as will become more apparent.

The end sections 40 have the same length $L_3$ which is selected so that the projection end edges 60 on one of the liner blanks 16 will abut the end edge 60 of the other liner blank 16 along the center of the end panel 21 on the main body blank 15.

Each of the end sections 10 has a handle flap portion 61 cut therein which corresponds to about one-half the hand cutout in the end panel 21. Thus, when the liner blanks 16 are erected where the end edges 60 of the two liner blanks abut, the handle flap portions 61 cumulatively align with the cutout 26 in the end panel 21 thereat. The handle flap portions 61 are Joined to the end portions 40 through a fold line 62 along the bottom of the handle flap portion 61.

Figure 4:
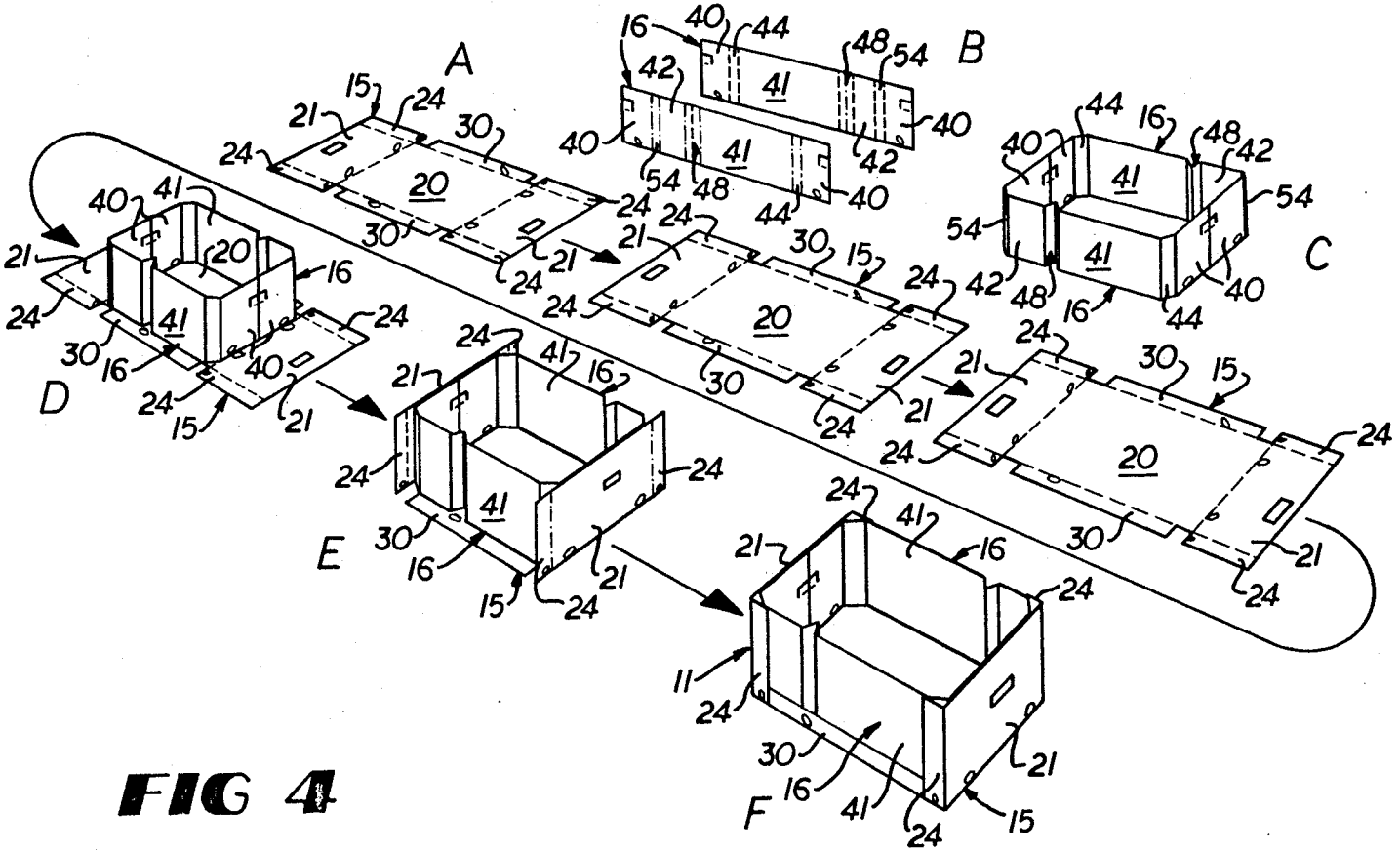
FIG. 4 is a schematic diagram illustrating the steps and erecting the open top box of FIGS. 1–3.

The erection of the blanks 15 and 16 into the box 11 is illustrated in FIG. 4. FIG. 4 shows the blanks 15 and 16 at the various stages of the erection process immediately after each erection step. For simplicity, the erection stages of the blanks 15 and 16 have been labelled A–F.

Stage A shows the interior side of the body blank 15 after the adhesive has been applied to maintain the box 11 erected. For clarity, the adhesive AD has been shown only in FIG. 3 and not in FIG. 4. The adhesive AD is applied to end panels 21 and the end flaps 21 and those portions of the side flaps 30 which will overlie the major and minor side sections 41 and 42 on liner blanks 16.

Stage B shows the liner blanks 16 positioned above the main body blank 15 ready to be formed. During forming, the column section 48 is upset along fold lines 50–52 to form an open sided column CL therein as seen in Step C. At the same time the corner baffle sections 44 and 5; and the end sections 40 are folded along fold lines 45 and 46 and 55 and 56 respectively until the baffle sections 44 and 54 define angles of about 135° with both the side section 41 or 42 and the end section 40. The end edges 60 of the two liner blanks 16 are also abutted with each other as seen in step C.

As seen in step D, the erected liner blanks 16 are lowered into place on the bottom panel 20. The main body blank 15 is now ready for erection. The end panels 21 and end flaps 24 are then folded to an upright position so as to bring the adhesive AD on the end panels 21 into contact with the abutted end section 40 on the erected liner blanks 16 as seen in Stage E.

Finally, the end flaps 24 are folded around and into contact with the major or minor side section 41 or 42 adjacent the end flap. This brings the adhesives AD on the end flap 24 into bonding contact with the liner 16. The erected shape of the corner structure CS is thus maintained.

As best seen in FIG. 2, one of the columns CL is located the distance $d_{co}$ from one end of the box 11 while the other column CL is located the distance $d_{co}$ from the other end of the box. The distance $d_{co}$ corresponds to the box width $W_B$ so that one of the columns CL will be located at the crossover point of the side of a cross-stacked container 10 as shown by phantom lines in FIG. 2. The box 11 would, of course, have a cover 14 when stacked.

To maintain the durability of the blanks 15 and 16 as well as the finished box 11, a wax water barrier is used. The blanks are usually was impregnated with about 6 pounds/1000 ft.$^2$ and then curtain coated with an additional 6.5 pounds/1000 ft.$^2$ of wax blend.

To minimize the deterioration of the corrugated fibreboard, it is critical that the corer edges CE and the columns CL be exposed to the minimum moisture. To provide this, the drain holes 29 in the end flaps 24 are spaced from the corner edge CE but still within the bottom of the cavity CC between the baffle section 44 or 54 and the end flap 24 and end panel 21 so that any liquid passing into the cavity CC either through the top thereof or seeping under the baffle section 44 of 54 will be drained. This minimizes moisture contact with the corner edge CE to maximize its life. Likewise, the column drain holes 34 drain the short cavity SC between the column section 48 and the side flap 30 to minimize moisture exposure to the column CL.

It will be noted that the columns CL are located out of transverse registration with each other. Because the columns CL are the weakest portions of the box side walls against forces pushing the end panels 21 toward each other, transversely offsetting them minimizes the tendency of the box to buckle along a transverse path at the columns. This tendency is further offset by the flutes F in the side flaps 30 extending longitudinally of the box.

The bottom of the box needs to be resistant to puncturing if the box is inadvertently set down on an object or projection after loading. Because the loaded box is lifted at the handholes in the ends of the box, the overlapped end panels 21 and end sections 40 need to be highly resistant to tear out at the handholes. The body blank 15 may be made out of a heavier corrugated fibreboard such as a 52/40/52 board while the liner blanks may be a 47/40/47 board to achieve this result. Likewise, the flutes in the end panels 21 may be arranged transversely of the flutes in the end sections 40 to strengthen the ends of the box against tearout.

It will be appreciated that different numbers and locations of the columns CL may be used without departing from the scope of the invention. Three different configurations are illustrated in FIGS. 5–7 and have been respectively designated 11', 11'', and 11'''.

As seen in FIG. S, the box 11' has four columns CL formed in the erected liner blanks 16'. The columns CL are transversely opposed with each opposed set of columns oriented along the crossover points when the boxes are cross stacked. Appropriate drain holes (not shown) corresponding to the drain holes 34 in box 11 are provided in body blank 15' in registration with the cavity behind the columns CL to drain any seepage from the cavity.

The box 11'' seen in FIG. 6 also has four columns CL formed in the erected liner blanks 16''. These columns are located in the vicinities of the crossover points on the box but out of transverse alignment with each other. Appropriate column drain holes (not shown) are provided in the main body blank 15'' to drain the column cavities.

The box 11''' seen in FIG. 7 has a pair of opposed columns CL formed in the erected liner blanks 16'''. Appropriate drain holes (not shown) are provided in main body blank 15'''to drain the column cavities.

SECOND EMBODIMENT

Figure 8:
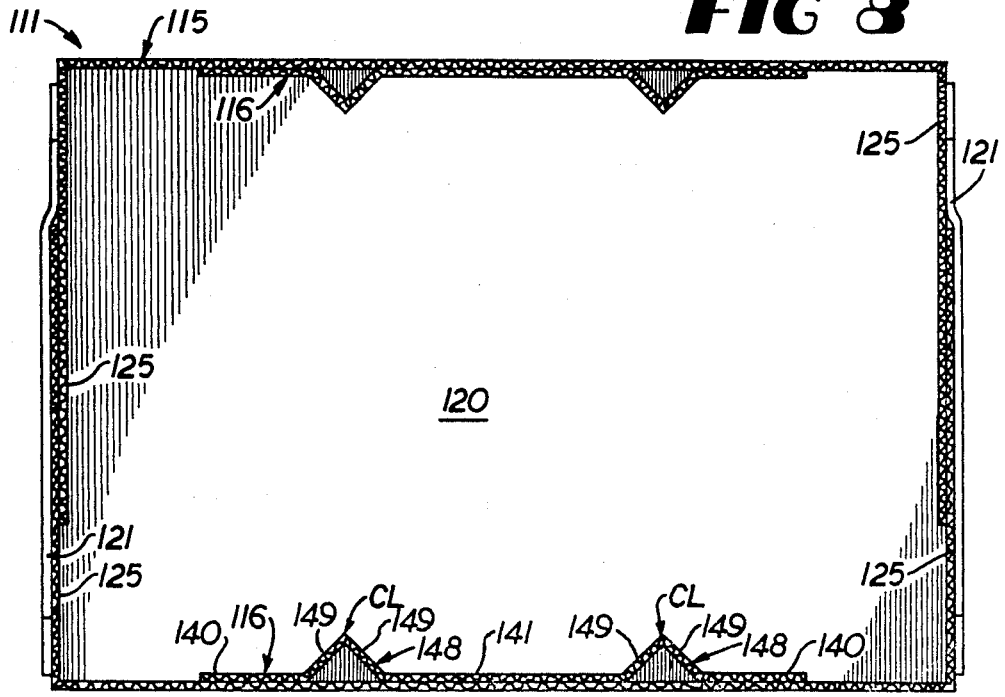
FIG. 8 is a top view of a second embodiment of the open top box of the container.
Figure 10:
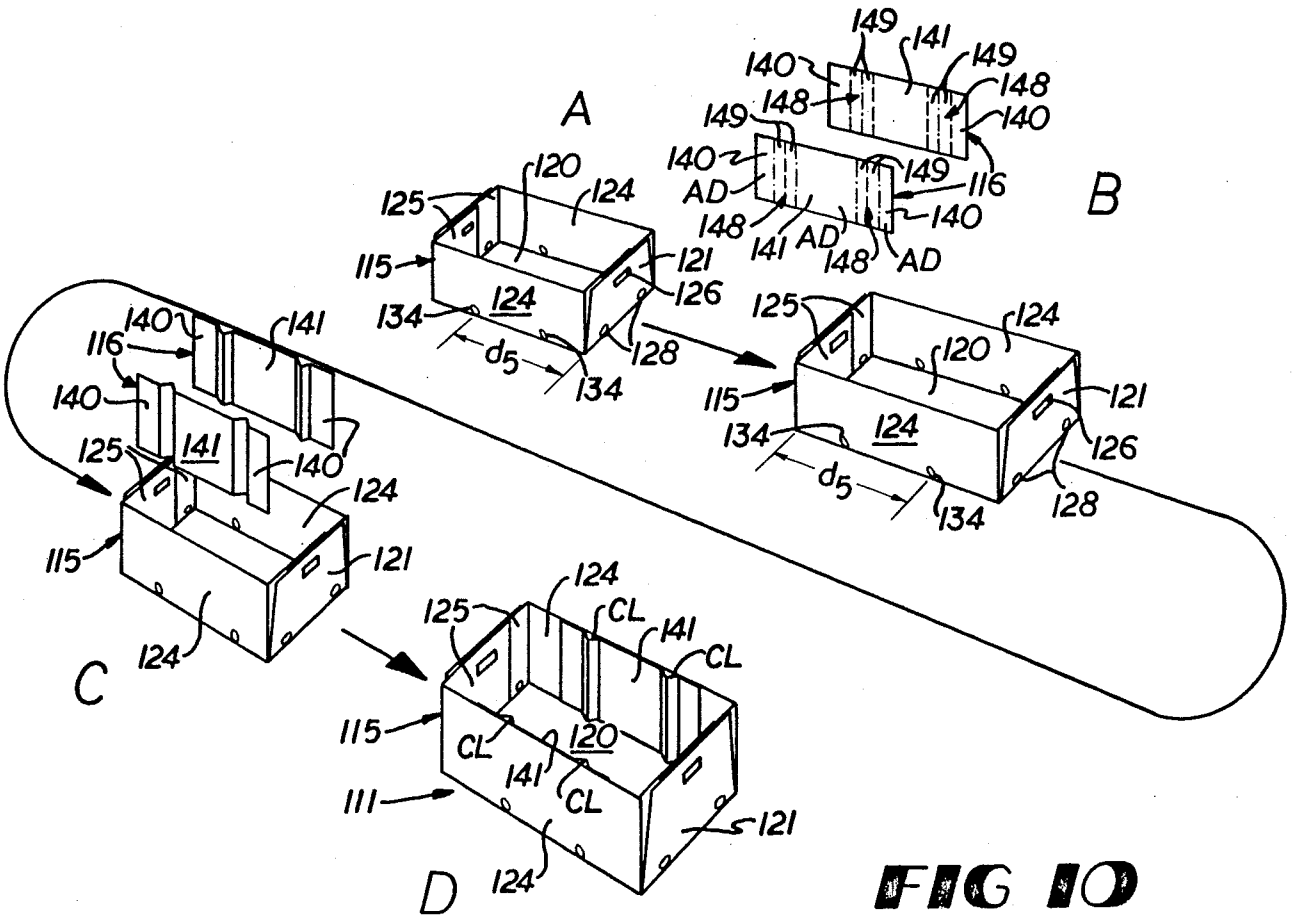
FIG. 10 is a schematic diagram illustrating the steps in erecting the container of FIG. 8.

The second embodiment of the box is illustrated in FIGS. 8 and 10 and designated 111. The box 111 is erected from a box blank 115 and a pair of column blanks 116 best seen in FIG. 10. A cover 14 would be used with the box 111. The blanks 115 and 116 are also single wall corrugated fibreboard sheets. The box blank 115 includes a rectilinear bottom panel 120 with opposed ends and opposed sides. A pair of end panels 121 are foldably joined to the bottom panel 120 along the opposite ends thereof. The end panels 121 have a height corresponding to the height of the erected box. A pair of side panels 124 are integral with opposite side edges of the bottom panel 120. A pair of end flaps 125 are integral with opposite ends of the side panels 124 and are sized to overlap each other inside end panels 121 when the box is erected. The end flaps 125 have the same height&as the end panels 121 to provide additional end support as will become more apparent. Handhold cutouts 126 are centrally located in the end panels 121 and end flaps 125 in the upper portion thereof as will become more apparent.

Weep holes 128 are provided through the end panels 121 and end flaps 125 adjacent the box corners as best seen in FIG. 10. Each side panel 125 is provided with a pair of column drain holes 134. One hole 134 is located a distance $d_5$ from one end of the box while the other column drain hole 134 is located the distance $d_5$ from the opposite end of the box. The distance $d_5$ corresponds to the width of the box 111.

The column blanks 116 have the same configuration and are mirror images of each other when they are erected on box blank 115 to form the open top box 111. Each column blank 116 has a height equal to the box height and includes a pair of end sections 140 at opposite ends thereof connected to a center section 141 by a pair of column sections 148. Each column section 148 includes a pair of edge panels 119 foldable joined to each other to form a column when erected.

THIRD EMBODIMENT

Figure 9:
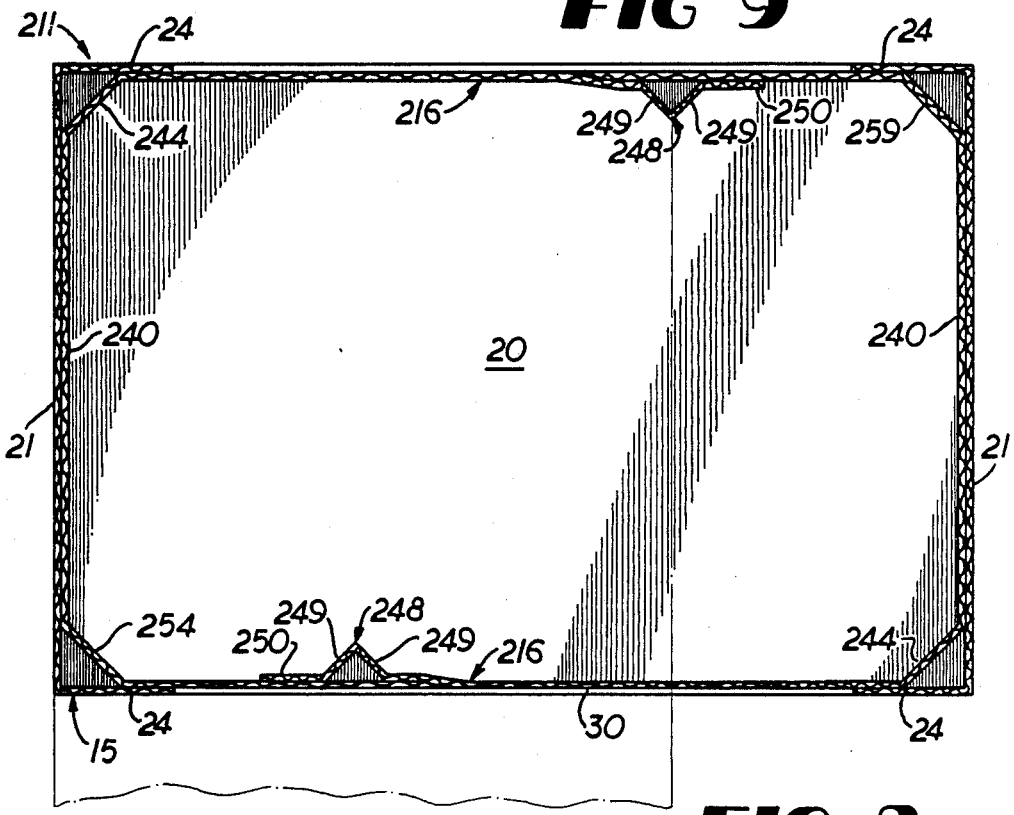
FIG. 9 is a top plan view of the third embodiment of the open top box of the container.
Figure 11:
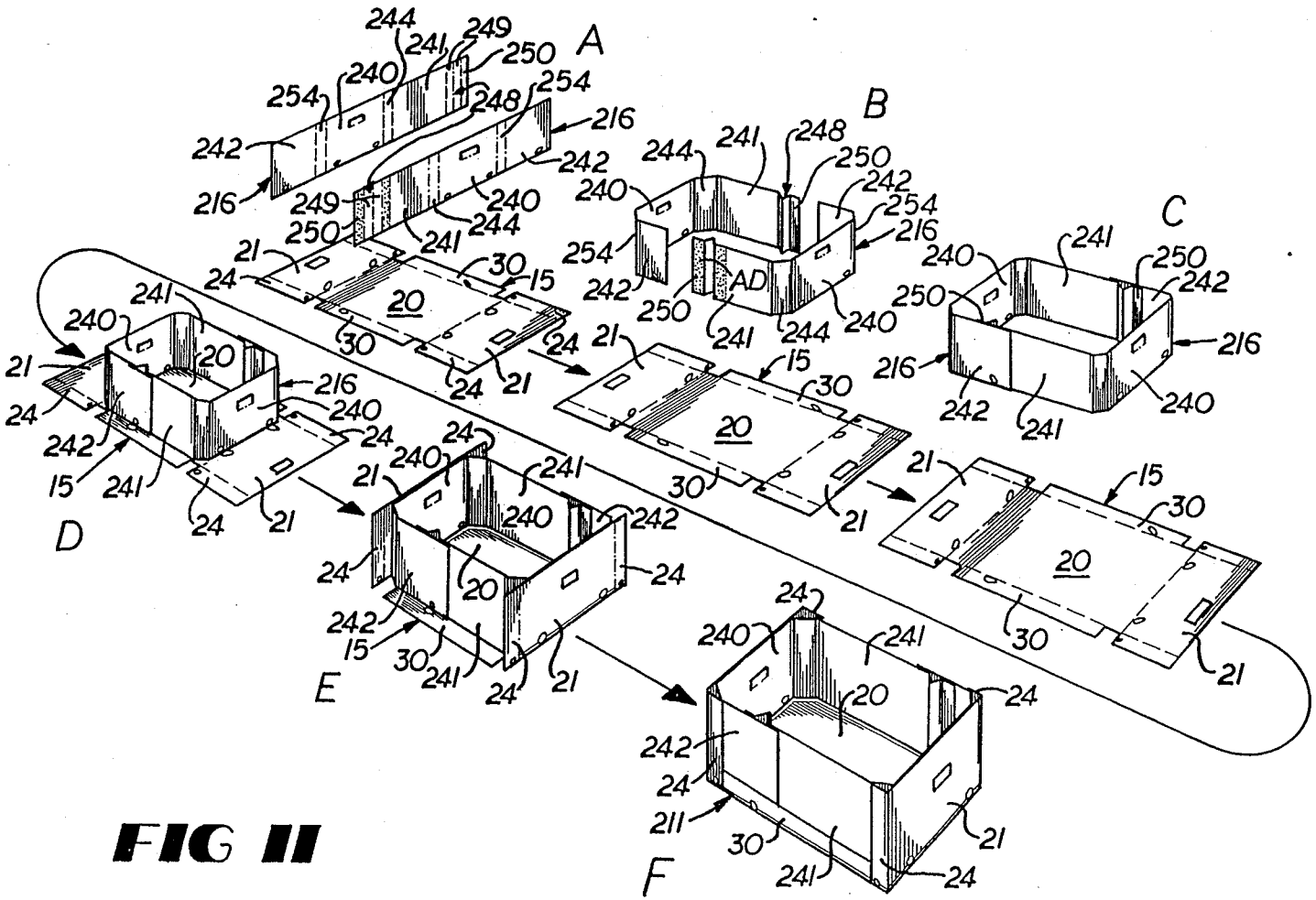
FIG. 11 is a schematic diagram illustrating the steps in erecting the container of FIG. 9.

The third embodiment of the box of the invention is illustrated in FIGS. 9 and 11 and designated 211. The open top box 211 is erected from the main body blank 15 of the first embodiment and a pair of liner blanks 216 as seen in FIG. 11. The cover 14 is used to close the box.

The liner blanks 216 have the same configuration and are simply turned so that they are mirror images of each other when they are erected on body blank 15 to form the open top box 211. Each liner blank 216 includes an end section 240 adapted to lie against one of the end panels 21 as will become more apparent. The liner blank 216 also includes a major side section 241 and a minor side section 242 adapted to form a portion of each side of the open top box when erected.

One end of the ma)or side section 241 is connected to the end section 240 through a corner baffle section 244. The opposite end of side section 241 is connected to a column section 248. Column section 248 includes a pair of edge panels 249 Joined to each other about a reverse fold line. The opposite side of the column section 248 is joined to an edge flap 250. The edge flap 250 is used to hold the column formed in section 248 in place after the box 211 is erected. The opposite end of the end section 240 is connected to minor side section 242 through the corner baffle section 254. The lengths of the side sections 241 and 242 are such that the end of each minor side section 242 extends outboard of the column section 248 to overlap a portion of the protecting end of the major side section 241 to reinforce the column formed therein. Adhesive AD is applied between the overlapped portions of the minor side section 242 with both the side section 241 and the edge flap 250.

The column section 48 will be located along the length of the bottom panel 20 depending on the relative length $L_1$ of the major side section 41 and the length $L_2$ of the minor side section 42. These length $L_1$ and $L_2$ are selected for the first embodiment of the liner blank 16 so that, when the edge panels 49 and the column section 48 are folded along the reverse fold line 50 and the inward fold lines 51 and 52, the column formed thereby will be located in registration with the drain holes 34 at the distance $d_5$ from the fold line 22. Because the liner blanks 16 are erected so that they are mirror images of each other, one of the columns formed by the section 48 will be located at the distance $d_5$ from one of the fold lines 22 while the other column will be located from the other fold line the distance $d_5$. Thus, it will be seen that the columns in the erected box 11 will be located out of transverse alignment with each other as will become more apparent.

The end sections 40 have the same length $L_3$ which is selected so that the projecting end edges 60 on one of the liner blanks 16 will abut the end edge 60 of the other liner blank 16 along the center of the end panel 21 on the main body blank 15.

Each of the end sections 40 has a handle flap portion 61 cut therein which corresponds to about one-half the hand cutout in the end panel 21. Thus, when the liner blanks 16 are erected where the end edges 60 of the two liner blanks abut, the handle flap portions 61 cumulatively align with the cutout 26 in the end panel 21 thereat. The handle flap portions 61 are joined to the end portions 40 through a fold line 62 along the bottom of the handle flap portion 61.

The erection of the blanks 15 and 216 into the box 211 is illustrated in FIG. 11. FIG. 4 shows the blanks 15 and 16 at the various steps in the erection process. For simplicity, the erection steps of the blanks 15 and 216 have been labelled A–F.

Steps A shows the interior side of the body blank 15 after the adhesive AD has been applied to maintain the box 211 erected as described for the first embodiment. Also, the adhesive AD has been applied to the flaps 250 and overlapped portions of major side sections 241.

Step B shows the liner blanks 216 positioned above the main body blank 15 and preformed prior to assembly. During preforming, the column section 248 is upset to form an open sided column CL therein as seen in Step B. At the same time the corner baffle sections 214 and 254 and the side sections 241 and 242 are folded until the baffle sections 244 and 254 define angles of about 135° with both the side sections 241 and 242 and the end section 240. Finally the two liners are overlapped and the minor side sections 242 bonded to the edge flap 250 and major side section 241 as seen in Step C.

As seen in Step D, the erected liner blanks 216 are lowered into place on the bottom panel 20. The main body blank 15 is then erected as with the first embodiment and as shown in Steps E and P. In the erected box 211 the overlapped column is closed by section 242 to further strengthen the column.

What is claimed as invention is:

1. A container formed from foldable sheet material comprising an erected body member and a pair of erected liner members, said body member including:

a bottom panel having opposed sides and opposed ends;

a pair of end panels foldably joined to the opposed ends of said bottom panel and having a prescribed box height and defining hand openings therein; and a pair of side flaps foldably joined to opposite side edges of said bottom panel and having a flap height less than said prescribed box height;

and each of said liner members having a height substantially that of said prescribed box height and including:

at least one end section lying against one of said end panels of said body member and defining a hand opening therein;

at least one side section lying against one of said side flaps on said erected body member; and at least one foldable column section connected to said side section, vertically oriented and projecting interiorily of said erected container;

said erected container defining an open top cavity therein with said end sections on said liner members overlying said end panels on said body member with said hand openings in registration and with said side flaps overlying a portion of said side sections in said liner members adjacent said bottom panel whereby said side sections and said column sections project beyond said side flaps; and adhesive means bonding said end panels on said body member to said end sections on said liner members and said side flaps on said body member to said side sections on said liner members to maintain said column sections in an erected position.

each of said liner members including one of said end sections sized to correspond generally to one of said end panels on said body member; including first and second of said side sections foldably connected to opposite ends of said end section and adapted to extend along opposite sides of said erected container; including one of said foldable column sections foldably connected to the end of said first side section opposite said end section; and includeing an edge flap foldably joined to that side of said one of said column sections opposite said first side section, said first and second side sections sized so that a portion of said second side section on one of said liner members overlaps both said erected column section and a portion of said first side section in the other of said liner members in the vicinty of said column section in the other of said liner members, said adhesive means bonding said edge flaps to the overlapped portions of said second side sections and bonding said second side sections to said first side sections in the vicinity of said one of said column section.

2. The container of claim 1 for supporting ice packed products such as poultry and the like wherein said body member includes a pair of end flaps foldably joined to opposite ends of each of said end panels and forming corners with said end panels in said erected container, and wherein each of said liner members further includes baffle sections between said end and side sections and extending diagonally across each of the corners formed between the erected end panels and end flaps to separate the interior of the container from the corners so as to minimize the moisture to which the corners are exposed when ice is contained in said cavity.

3. The container of claim 2 wherein each of said baffle sections defines a space between said baffle section and the corner and wherein said end panel and said side flap define at least one drain hole therethrough adjacent the lower portion of the space to drain liquids from within the space exteriorily of said container.

4. The container of claim 1 wherein each of said liner members is constructed and arranged so that said foldable column sections in said liner members are offset with respect to each other transversely of said container.

5. The container of claim 1 wherein said column section in one of said side walls of said erected liner members is located a prescribed crossover distance from one end of said container about the same as the width of said container while the other of said column sections in the other of said liner members is located at the prescribed crossover distance from the other end of said container.

6. The container of claim 5 wherein each of said liner members includes two of said upright column sections, one of said upright column sections in each of said side sections located the prescribed crossover distance from one of said container while the other of said column sections in said side section is located the prescribed crossover distance from the other end of said container.

7. The container of claim 6 wherein said column sections in said side sections are located approximately at the crossover distance but out of alignment with each other transversely of said container.

8. The container of claim 1 wherein each of said erected foldable column section are located about equidistant from said erected end panels.

9. The container of claim 1 wherein said side flaps form a tubular portion with said erected column sections and wherein said side flaps define column drain holes therethrough opening interiorily of the space between said erected column section and said side flap and exteriorily of said side flap to drain the tubular portion of said column section.

10. The container of claim 1 wherein said each of said liner members includes a pair of said end sections at opposite ends of said members and a pair of said side sections connected by said column sections, said end sections foldably connected to the ends of said side sections opposite said column sections, said container erected so that one of said end sections on each of said liner members overlaps one of said end panels on said body members and said end sections abut each other.

11. The container of claim 10 wherein said body member includes a pair of end flaps foldably joined to opposite ends of each of said end panels and forming corners with said end panels in said erected container, and wherein each of said liner members further includes baffle sections between said end and side sections and extending diagonally across each of the corners formed between the erected end panels and end flaps to separate the interior of the container form the corners so as to minimize the moisture from within the cavity to which the corners are exposed.

12. The container of claim 11 wherein each of said baffle sections defines a space between said baffle section and the corner; wherein said end panel and said side flap define at least one drain hole therethrough adjacent the lower portion of the space to drain liquids from within the space exteriorily of said container; and wherein said side flaps form a tubular portion with said erected column sections and wherein said side flaps define column drain holes therethrough opening interiorily of the space between said erected column section and said side flap and exteriorily of said side flap to drain the tubular portion of said column section.

13. The container of claim 12 wherein said body member and liner members are treated with a moisture barrier to reduce the penetration of moisture therethrough.

14. The container of claim 13 further including a flanged cover adapted to overlie the open top cavity to close same.

15. The container of claim 1 wherein said body member and said liner members are treated with a moisture barrier to reduce the penetration of moisture therethrough.

16. The container of claim 1 further including a flanged cover adapted to overlie the open top cavity to close same.

* * * * *